United States Patent [19]

Sneijers

[11] 4,277,725

[45] Jul. 7, 1981

[54] GAS AND/OR VAPOR DISCHARGE LAMP

[75] Inventor: Andreas P. E. Sneijers, Eindhoven, Netherlands

[73] Assignee: U.S. Philips Corporation, New York, N.Y.

[21] Appl. No.: 69,441

[22] Filed: Aug. 24, 1979

[30] Foreign Application Priority Data

Sep. 5, 1978 [NL] Netherlands ..... 7809055

[51] Int. Cl.[3] ..... H01J 7/44; H01J 17/34; H01J 19/78; H01K 1/62

[52] U.S. Cl. ..... 315/73; 315/60; 315/72; 315/104; 315/124

[58] Field of Search ..... 315/60, 61, 63, 72, 315/73, 104, 124, 330, 349, 62

[56] References Cited

U.S. PATENT DOCUMENTS

| | | | |
|---|---|---|---|
| 3,445,721 | 5/1969 | Waymouth | 315/60 |
| 3,619,710 | 11/1971 | Waymouth | 315/59 |
| 4,064,416 | 12/1977 | Krense et al. | 315/60 |
| 4,117,370 | 9/1978 | Jacobs et al. | 315/61 |
| 4,144,475 | 3/1979 | Delen et al. | 315/73 |
| 4,179,640 | 12/1979 | Larson et al. | 315/73 |

*Primary Examiner*—Saxfield Chatmon, Jr.
*Attorney, Agent, or Firm*—Robert S. Smith

[57] ABSTRACT

The invention relates to a high-pressure sodium lamp which is provided with a discharge tube having an external auxiliary electrode. The auxiliary electrode is switched off by a bimetallic switch in the operating condition of the lamp.

According to the invention the lamp also comprises a glow starter which in the operating condition of the lamp is switched off by means of the same bimetallic switch. This apparatus achieves in a simple manner, a large available voltage for igniting the discharge tube with an operating condition of the lamp in which no disturbance is experienced from any of the ignition auxiliary means.

5 Claims, 2 Drawing Figures

GAS AND/OR VAPOR DISCHARGE LAMP

Figure 1:
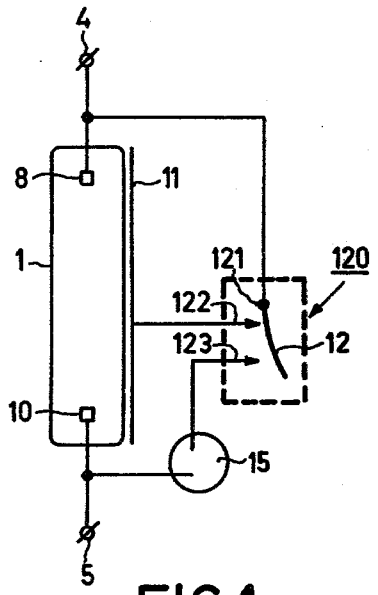

The invention relates to a gas and/or vapour discharge lamp having a discharge tube with at least two main electrodes and an external ignition auxiliary means. The lamp includes a bimetallic switch having at least two connection contacts, the first main electrode being connected to the first connection contact and the external ignition auxiliary means being connected to the second connection contact. All the connection contacts of the bimetallic switch in the inoperative condition of the lamp electrically, are connected electronically, the electric contact between each of the connection contacts being interrupted in the operating condition of the lamp.

A lamp of the kind mentioned in the opening paragraph is disclosed, for example, in U.S. Pat. No. 4,037,129. An advantage of this known lamp is that in the operating condition of the lamp the auxiliary electrode is switched off. However, in this known lamp the available ignition voltage is the same as the voltage between two input terminals of the lamp. This voltage is either comparatively low, namely substantially equal to the available line voltage, or has a high value, namely in the case in which an external starter is used.

The disadvantage of the use of a comparatively low ignition voltage is that it restricts the design possibilities for the operating condition. The above-mentioned use of a high ignition voltage has the disadvantage that an external starter is necessary which inter alia should be mounted separately in the circuit.

It is the object of the invention to enable, for a lamp of the kind mentioned in the opening paragraph a comparatively high ignition voltage to be made available for the discharge tube without an external starter while maintaining the advantage of switched-off ignition auxiliary means in the operating condition of the lamp.

A gas and/or vapor discharge lamp of the kind mentioned in the opening paragraph is characterized in that the bimetallic switch has a third connection contact and that the lamp has a glow starter which is connected between the third connection contact and the second main electrode.

An advantage of a lamp according to the invention is that a high ignition voltage can nevertheless be applied to the discharge tube without an external starter, while all the ignition auxiliary means are switched off in the operating condition of the lamp via the bimetallic switch.

The invention is based on the idea of also using the bimetallic switch already present for switching a glow starter which serves as an ignition auxiliary means.

It is to be noted that a glow starter is known per se as a part of a discharge lamp from French Patent Application No. 7711412 (PHN 8368). However, in this case neither an external ignition auxiliary means nor a bimetallic switch is present.

A bimetallic switch may consist, for example, of three connection contacts and a separately fixed bimetallic strip.

In a preferred embodiment of a lamp according to the invention the bimetallic switch consists of a bimetallic strip which is fixed to the first connection contact. An advantage of this lamp is that no separate fixing point is necessary for the bimetallic strip.

An external ignition auxiliary means may be, for example, a heating coil along the discharge tube.

A bimetallic strip of a bimetallic switch may, for example, bear against an auxiliary electrode in the closed condition of the bimetallic switch.

In a further embodiment of a lamp according to the invention, the external ignition auxiliary means is an auxiliary electrode and in the inoperative condition of the lamp the bimetallic strip bears against a portion of the auxiliary electrode which forms the second connection contact. An advantage of a lamp having a bimetallic switch according to this construction is that a simple construction has been obtained and that the bimetallic strip is heated by the thermal radiation radiated by the discharge tube.

A bimetallic strip which is secured to a pole wire and which in the cold condition of the lamp bears on the discharge tube is known per se from U.S. Pat. No. 3,872,340 (which is the counterpart of Netherlands Patent Application No. 7,506,251). In this case, however, the bimetallic strip serves as an external auxiliary electrode and not as a switch.

A gas and/or vapor discharge lamp according to the invention may be, for example, a low-pressure gas discharge lamp.

In another preferred embodiment of a lamp according to the invention the lamp is a high-pressure metal vapor discharge lamp.

An advantage of a lamp according to the invention is that a compact lamp having a large specific light flux and good ignition properties can be obtained.

In a further embodiment the lamp is a high-pressure sodium vapor discharge lamp in which the discharge tube also contains xenon which at a temperature of 300 K. has a partial gas pressure exceeding 15,000 Pa (120 Torr). An advantage of such a lamp is that a lamp having good ignition properties and a very high specific luminous efficiency can be obtained.

Figure 2:
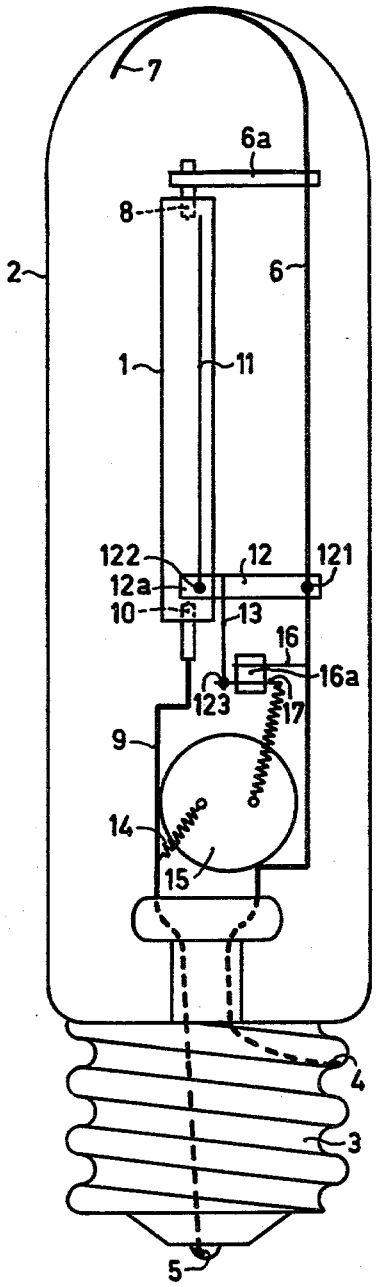

An embodiment of the invention will now be described in greater detail, by way of examples with reference to the accompanying drawing. In the drawing:

FIG. 1 shows an electric circuit diagram of a lamp according to the invention, and FIG. 2 is a longitudinal sectional view of a lamp according to the invention and having the circuit shown in FIG. 1.

In FIG. 1, a discharge tube 1 is connected to two connection terminals 4 and 5, connection terminal 4 being connected to main electrode 8 and connection terminal 5 being connected to main electrode 10. Connection terminal 4 is also connected to connection contact 121 of a bimetallic switch 120. A bimetallic strip 12 is fixed to the connection contact 121 and in the inoperative condition of the lamp bears against both a connection contact 122 to which an auxiliary electrode 11 is connected and to a connection contact 123 which is connected to a glow starter 15. The glow starter 15 is also connected to the main electrode 10.

The reference numerals of FIG. 2 correspond to those of FIG. 1. 1 Denotes a discharge tube which is enveloped by an outer envelope 2 which has a lamp cap 3 with two leadthroughs 4 and 5. The leadthrough 4 is connected to a rigid current conductor 6 which is shaped to provide a supporting brace 7 at its other end. An auxiliary current conductor **6*a* is connected to conductor 6 and to the internal main electrode 8 of the tube 1. The leadthrough 5 is connected to a current conductor 9 which is connected to the second internal main electrode 10 of the tube 1. A strip-shaped auxiliary electrode 11 is provided on the outer surface of the discharge tube 1**.

At the area of the connection contact 121 the bimetallic strip 12 is fixed to the rigid current conductor 6, one end 12*a* of said strip in the inoperative condition of the lamp bearing against the discharge tube 1 on to the connection contact 122 which is part of the auxiliary electrode 11.

A conductive rod-shaped projection 13, preferably made from tungsten, is connected to the bimetallic strip 12 and in the inoperative condition of the lamp bears against connection contact 123 formed on a conductor 17. The conductor 17 is connected to the glow starter 15 which is supported by the rigid current conductor 6 via an auxiliary rod 16 and a glass bead 16*a*. On its other side the glow starter 15 is connected to the current conductor 9 via conductor 14.

The described lamp is a high-pressure sodium lamp of 70 Watts, xenon being also present in the discharge tube and having a partial pressure of approximately 26,000 Pa (200 Torr) at 300 K. Via an inductive stabilization ballast (not shown) of approximately 0.6 Henry the lamp is connected to a supply mains of approximately 220 Volts, 50 Hz.

The operation of the lamp shown in FIG. 2 will now be explained. When the lamp is connected to line voltage via the stabilization ballast a glow discharge will first be formed in the glow starter 15. As a result of this, thermal energy is generated so that both contacts in the glow starter 15 will bend towards each other and finally make contact. A current will then flow in the circuit elements identified by the numerals 4, 6, 121, 12, 13, 123, 17, 15, 14, 9, 5. The glow starter 15 will then cool again so that after some time its contacts will move apart again. This switching-off of the glow starter causes a voltage pulse of approximately 2000 Volts which is set up both between the main electrodes 8 and 10 and between the main electrode 10 and the auxiliary electrode 11 via the rod-shaped projection 13 and the bimetallic strip 12. As a result of this an electric field is generated in the discharge tube by which the discharge between the main electrodes 8 and 10 is ignited. If this does not occur the first time, the procedure with the glow starter will be repeated.

Once the discharge between the main electrodes 8 and 10 has been ignited, the bimetallic strip 12 will be heated by the thermal evolution and will bend away from the discharge tube 1. The result of this is that the end 12*a* thereof no longer contacts the external auxiliary electrode 11, while the contact between the conductor 17 and the rod-shaped projection 13 is also interrupted. This means that in this case both the glow starter 15 and the auxiliary electrode 11 are switched off. They can thus no longer have a disturbing effect in the operating condition of the lamp.

What is claimed is:

1. A gas and/or vapor discharge lamp having a discharge tube with at least first and second main electrodes and an external ignition auxiliary means, and a bimetallic switch having a least three connection contacts, the first main electrode being connected to the first connection contact and the external ignition auxiliary means being connected to the second connection contact, all the connection contacts of the bimetallic switch in the inoperative condition of the lamp being mutually connected electrically, the mutual electric contact between each of the connection contacts being interrupted in the operating condition of the lamp, and said lamp further including a glow starter which is connected between the third connection contract and the second main electrode.

2. A gas and/or vapor discharge lamp as claimed in claim 1, characterized in that the bimetallic switch comprises a bimetallic strip which is fixed to the first connection contact.

3. A gas and/or vapor discharge lamp as claimed in claim 1 or 2 in which the external ignition auxiliary means is constructed as an auxiliary electrode characterized in that in the inoperative condition of the lamp the bimetallic strip bears against a portion of the auxiliary electrode which forms the second connection contact.

4. A gas and/or vapor discharge lamp as claimed in claim 1, 2 or 3, characterized in that the discharge lamp is a high-pressure metal vapor discharge lamp.

5. A lamp as claimed in claim 4, characterized in that the lamp is a high-pressure sodium vapor discharge lamp and that the discharge tube also comprises xenon which at a temperature of 300 K. has a partial gas pressure exceeding 15,000 Pa (120 Torr).

* * * * *